US005090705A

United States Patent [19]

Oka et al.

[11] Patent Number: 5,090,705

[45] Date of Patent: Feb. 25, 1992

[54] GOLF BALL

[75] Inventors: Kengo Oka; Susumu Yoshida; Yoshiyuki Mimoto, all of Kobe; Tadahiro Ebisuno, Nishinomiya; Yoshikazu Yabuki, Akashi, all of Japan

[73] Assignee: Sumitomo Rubber Industries, Ltd., Hyogo, Japan

[21] Appl. No.: 565,974

[22] Filed: Aug. 13, 1990

[30] Foreign Application Priority Data

Aug. 23, 1989 [JP] Japan ..... 1-217138

[51] Int. Cl.[5] ..... A63B 37/14

[52] U.S. Cl. ..... 273/232

[58] Field of Search ..... 273/232, 220; 40/327

[56] References Cited

U.S. PATENT DOCUMENTS

| | | | |
|---|---|---|---|
| 4,744,564 | 5/1988 | Yamada | 273/232 |
| 4,880,241 | 11/1989 | Melvin et al. | 273/232 |
| 4,949,976 | 8/1990 | Gobush | 273/232 |
| 4,960,281 | 10/1990 | Aoyama | 273/232 |
| 4,960,282 | 10/1990 | Shaw | 273/232 |

FOREIGN PATENT DOCUMENTS

| | | | |
|---|---|---|---|
| 2127304 | 4/1984 | United Kingdom | 273/232 |
| 2150840 | 7/1985 | United Kingdom | 273/232 |
| 2203954 | 11/1988 | United Kingdom | 273/232 |

*Primary Examiner*—George J. Marlo

*Attorney, Agent, or Firm*—Birch, Stewart, Kolasch & Birch

[57] ABSTRACT

A golf ball which comprises a spherical surface having a parting line at its equator and having a plurality of dimples formed thereon, wherein the dimples are formed so that the ratio, y, of the sum total of the flat surface area of the dimples to the surface area of the same sphere having no dimples formed thereon is within the range $$((0.046)(X)^{\frac{1}{2}}-0.172)+0.04 \geqq Y \geqq ((0.046)(X)^{\frac{1}{2}}-0.172)-0.04$$

wherein X represents the total number of dimples;

and wherein a dimple lying within a region S, which extends from 30° below the parting line to 30° above the parting line, has a value VS, and a dimple of the same diameter only lying within the region P, which comprises the surface of the sphere that is not within region S, has a volume VP, such that the ratio of the volumes of dimples having the same diameters but in different regions is within the range of;

$1.02 \leqq VS/VP < 1.10$, when $y < 0.70$, $1.10 \leqq VS/VP, < 1.18$, when $0.70 \leqq y < 0.80$, and $1.18 \leqq VS/VP$, when $0.80 \leqq Y$.

8 Claims, 6 Drawing Sheets

Fig. 1 (II)

GOLF BALL

BACKGROUND OF THE INVENTION

1. Field of the Invention

The present invention relates to a golf ball, and more particularly, to a golf ball having improved aerodynamic characteristics through a combination of dimple factors including the total number of dimples on the surface of the golf ball, the ratio of the total surface area of the golf ball to the total surface areas of the dimples, and the volumes of the respective dimples corresponding to the regions or zones of the golf ball, etc.

2. Description of Related Arts

Normally, on the surface of a golf ball, 300 to 550 dimples in number are provided, the principal role of which is to improve aerodynamic characteristics of the golf ball, to optimize the trajectory, and to increase the carry or flying distance thereof.

There are many dimple factors that affect the trajectory of the golf ball. One of the factors which has a large influence on the trajectory the ratio of the total area of the dimples to the surface area of the golf ball (i.e. surface area occupying rate by the dimples).

Conventionally, studies have been made with respect to the surface area occupying rate of the dimples, and various techniques, such as those listed below, have been proposed.

(1) Japanese patent publication Tokkosho No. 58-50744 discloses a golf ball in which dimples are closely arranged through a reduction in pitch or by making the interval therebetween as small as possible.

(2) Japanese patent laid-open publication Tokkaisho No. 62-192181 discloses an arrangement in which, by utilizing dimples of differing diameters, the dimples are so closely arranged that in one land portion (i.e. the surface portion without any dimple) surrounded by the dimples, a new dimple having an area larger than an average area of the plurality of dimple sizes can not be formed.

(3) In Japanese patent laid-open publication Tokkaisho No. 64-8982, the surface area occupying rate of the dimples is over 65% through the use of non-circular dimples.

(4) In Japanese patent laid-open publication Tokkaisho No. 63-309282, the surface area occupying rate of the dimples is set to be more than 78% through a combination of two kinds of large and small dimples.

The known techniques listed above have a common technical concept. Namely, in that the dimples provided on the surface of the golf ball are arranged as close to each other as possible in order to improve the surface area occupying rate of the dimples, and thereby improve the aerodynamic characteristics and carry of the golf ball.

However, it is also known that the aerodynamic characteristics of the golf ball are largely affected by the total number of dimples, and in order to improve the aerodynamic characteristics of the golf ball for proper trajectory and increased carry, it is originally required to collectively take into account, both the surface area occupying rate of the dimples and the total number of dimples.

Conventionally, the above two factors are considered to be independent of each other, and in the prior art technique with respect to the surface area occupying rate of the dimples described above, the relation thereof with respect to the total number of dimples has not been particularly referred to. In other words, such prior art technique is based on a concept that the flight performance is improved through improvement of the surface area occupying rate of the dimples, irrespective of the total number of dimples, and thus, does not collectively take into consideration both the dimple surface area occupying rate and the total number of dimples.

Meanwhile, since the golf ball as described above is normally molded by a split metallic mold composed of semi-spherical upper and lower molds, a burr is formed at a junction of the molds, i.e. at a parting line between the upper and lower molds during the molding. Such a burr is scraped off in a later processing step by buffing wherein a seam portion is formed. Accordingly, dimples can not be provided on the seam portion so as to allow buffing of the burr. In other words, on the seam portion at both sides of the parting line, a great circle zone is formed which does not intersect any dimples and thus presents an aerodynamic characteristic that is clearly different from that of the spherical surfaces of other golf balls.

More specifically, when the golf ball is struck so that a line connecting both poles becomes a rotary axis of "back-spin", the portion where the circumferential speed of the rotary axis is the fastest coincides with the seam portion, thus undesirably lowering the trajectory height as compared with that when another line is set to be the rotary axis. Normally, the dimples at the portion where the circumferential speed is the fastest affect the trajectory height by the largest extent. Thus, with the seam portion, where no dimples are formed, at the fastest circumferential speed, the dimple effect of the golf ball on the whole is decreased and the generation of the lift is reduced. As described above, when the golf ball is hit, the trajectory height is undesirably altered depending on the portions struck by a club. Thus, not only is the interest of golf as a game reduced, but such a golf ball having a poor symmetrical nature is to be against the official rules set by USGA (United States Golf Association).

In order to solve the problem as described above, there has been proposed, for example, in Japanese Patent Laid-Open Publication Tokkaisho No. 61-284264, a technique in which by making the dimple volume in the vicinity of the seam portion larger than that in the vicinity of the pole, the dimple effect around the seam portion is improved, and thus the symmetrical nature of the aerodynamic characteristic of the golf ball on the whole is improved.

However, in the prior art technique as referred to above, although the ratio of the dimple volume in the vicinity of the seam portion, to the dimple volume in the vicinity of the pole is not stated from the viewpoint of the relation with respect to the surface area occupying rate of the dimples, it should be noted that these are closely related to each other. More specifically, as the dimples are arranged more closely at a larger surface area occupying rate, the difference in the dimple effect between the seam portion without any dimples formed and the other portion on the surface of the golf ball becomes larger. Accordingly, it is desirable to considerably increase the ratio of the dimple volume in the vicinity of the pole, to the dimple volume in the vicinity of the seam portion. On the other hand, when the surface area occupying rate of the dimples is small, i.e. when the dimples are arranged sparsely, the difference in the dimple effect between the seam portion without any dimple and the other portion of the surface of the golf ball becomes small. Accordingly, it is sufficient to slightly increase the ratio of the dimple volume in the vicinity of the seam portion, to the dimple volume in the vicinity of the pole.

SUMMARY OF THE INVENTION

Accordingly, an essential object of the present invention is to provide a golf ball in which it is intended to increase carry of the golf ball by properly combining two factors, i.e. the surface area occupying rate and the total number of the dimples which largely affect trajectory and carry of the golf ball.

Another object of the present invention is to provide a golf ball of the above described type in which the difference in dimple effect between a region including a portion not formed with dimples in the vicinity of the seam portion and the other region formed with dimples in the vicinity of the pole, is reduced by setting distribution of the dimple volume from the relation of the surface area occupying rate of the dimples and the number of dimples, thereby to decrease the difference in trajectory heights due to hitting positions of the golf balls.

In accomplishing these and other objects, according to one aspect of the present invention, there is provided a golf ball which includes a surface as an imaginary spherical surface, and dimples arranged on the imaginary, spherical surface in such a manner that when a ratio of sum total of flat faces for areas surrounded by outer edges of the respective dimples, to the surface area of said golf ball imaginary spherical surface is represented by y, the total number of dimples and the sum total of the dimple areas are combined for setting so that the value of y is in a range of $\pm 0.04$ of a value Y which is the optimum value of y as derived from the relation with respect to the dimple total number X by an equation, $$Y = 0.46 \cdot X^{178} - 0.172.$$

In another aspect of the present invention, there is provided a golf ball which includes a surface as an imaginary spherical surface, and dimples arranged on the imaginary spherical surface in such a manner that when a ratio of sum total of flat faces for area surrounded by outer edges of the respective dimples, to the surface area of said golf ball imaginary spherical surface is represented by y, a region less than 30° from a parting line of the golf ball by a central angle of the sphere is each represented as an S region, another region from more than 30° to a pole is each represented as a P region, a volume of one dimple located within said S region is represented as VS, and a volume of another dimple having a diameter equal to that of said cne dimple and located within said P region is represented as VP, the volumes of the dimples in said S region and P region are so set that, from the relation with respect to the value y representing the ratio of the dimples occupying the surface area, the values of said VS/VP are represented by, (a) in a golf ball of $y < 0.70$,
$1.02 \leqq VS/VP < 1.10$
(b) in a golf ball of $0.70 \leqq y < 0.80$,
$1.10 \leqq VS/VP < 1.18$, and
(c) in a golf ball of $0.80 \leqq y$,
$1.18 \leqq VS/VP$.

The dimples to be provided on the surface of the above golf balls include a plurality of kinds of dimples having different diameters, and the total volumes of these dimples should preferably be set in the range of 290 to 370 $mm^3$.

Particularly, it is preferable that the golf balls according to the present invention have constructions as follows.

In the first place, a golf ball having 480 dimples in total number including:
186 dimples with diameter of 3.95 mm
150 dimples with diameter of 3.55 mm
60 dimples with diameter of 3.05 mm
84 dimples with diameter of 2.75 mm In the second place, a golf ball having 432 dimples in total number including:
144 dimples with diameter of 4.20 mm
96 dimples with diameter of 3.85 mm
48 dimples with diameter of 3.45 mm
144 dimples with diameter of 3.15 mm In the third place, a golf ball having 408 dimples in total number including:
216 dimples with diameter of 4.05 mm
48 dimples with diameter of 3.90 mm
96 dimples with diameter of 3.50 mm
48 dimples with diameter of 2.80 mm In the fourth place, a golf ball having 384 dimples in total number including:
144 dimples with diameter of 4.15 mm
144 dimples with diameter of 3.85 mm
48 dimples with diameter of 3.35 mm
48 dimples with diameter of 2.95 mm In the fifth place, a golf ball having 342 dimples in total number including:
144 dimples with diameter of 3.95 mm
198 dimples with diameter of 3.70 mm.

In the golf ball according to the present invention as described above, since the surface area occupying rate of the dimples and the total number of dimples are combined in the optimum conditions, the aerodynamic characteristics of the golf ball can be improved, for increased carry thereof.

Moreover, owing to the fact that the difference in dimple effect between a region including a portion not formed with dimples in the vicinity of the seam and the other region formed with dimples in the vicinity of the pole, is reduced, the volumes of the dimples to be altered according to such regions are set from the relation with respect to the surface area occupying rate of the dimples, and when the value y is small, the volume ratio (VS/VP) is reduced, while when the value y is large, the volume ratio is increased, thereby to eliminate the difference in the dimple effects arising from the regions as far as possible.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
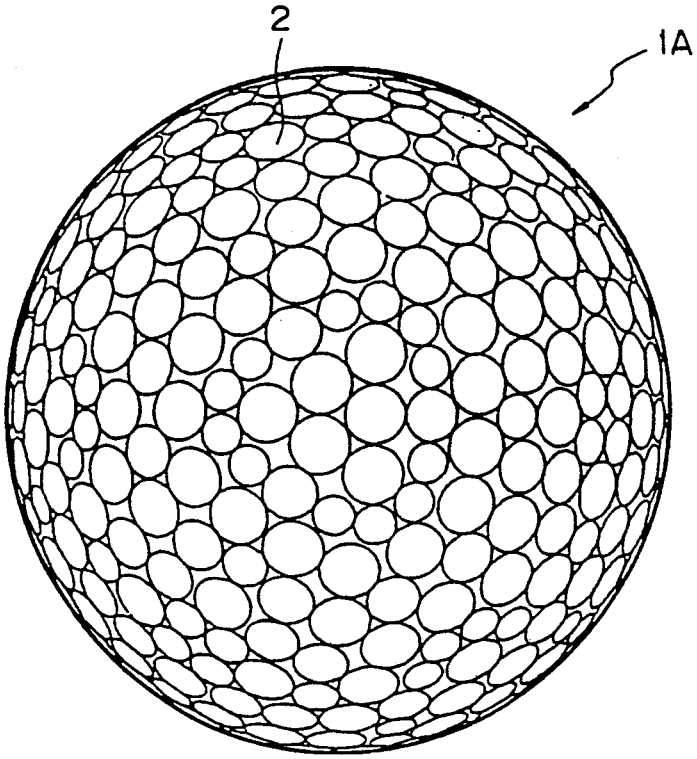
FIG. 1(I) is a front elevational view showing a dimple pattern of a golf ball 1A according to one preferred embodiment of the present invention, FIG. 1(II) is a view similar to FIG. 1(I) which particularly shows arrangement of dimples according to kinds thereof.
Figure 1:
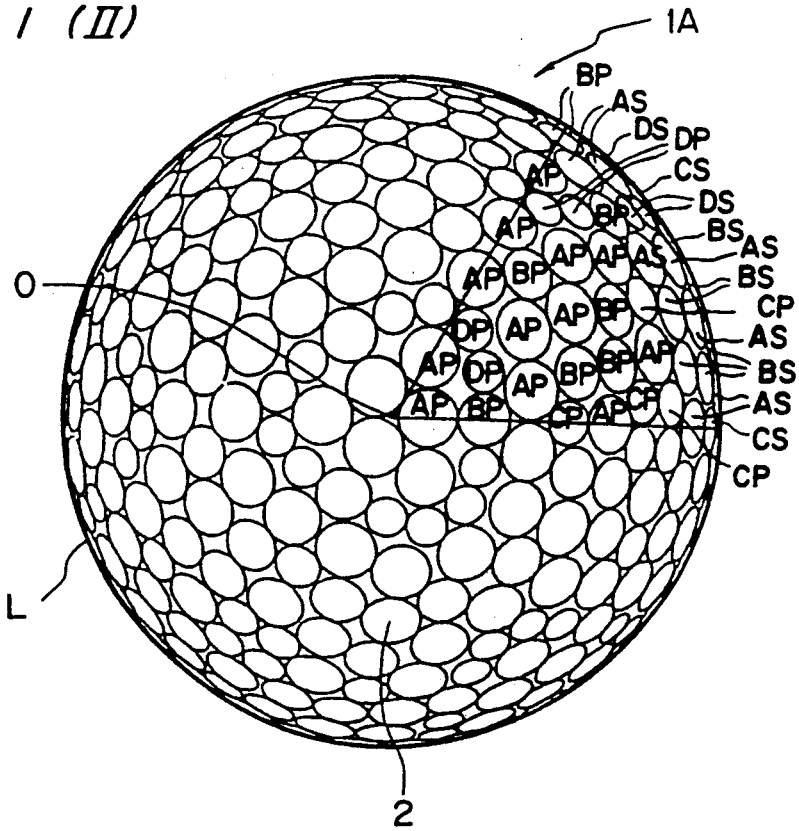

Before the description of the present invention proceeds, it is to be noted that like parts are designated by like reference numerals throughout the accompanying drawings.

Referring now to the drawings, there is shown in FIGS. 1(I) and 1(II), a dimple pattern of a golf ball according to one preferred embodiment of the present invention.

As shown in FIGS. 1(I) and 1(II), the golf ball 1A according to the first embodiment of the present invention is formed, on its surface, with a large number of dimples 2 having different diameters. It is to be noted here that although the dimples 2 form part of the spherical surface of the golf ball 1A, the shape of each dimple itself is not limited, but may be formed into any proper configuration depending on necessity.

The dimples 2 referred to above are set for dimensions, total number, disposition, and also volumes thereof to achieve optimum results through combination of the total number X thereof and the ratio of the total surface area of the dimples 2, to the surface area of the imaginary spherical surface of the golf ball 1A.

Figure 2:
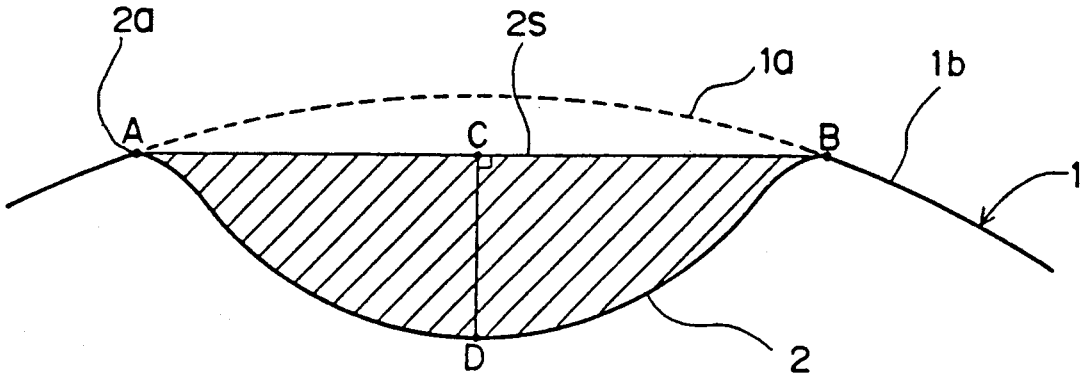
FIG. 2 is a schematic side sectional view showing a dimple on an enlarged scale for explanation.

As illustrated in FIG. 2, the area of the dimple 2 is represented by an area of a flat surface 2*s* surrounded by an outer edge 2*a* of each dimple 2. Therefore, in the case of a spherical dimple, the area of the dimple 2 means the area of a circle defined by intersection of part of a sphere forming the dimple, with the spherical surface of the golf ball 1, i.e. the area of a circle having a diameter connecting points A and B in FIG. 2. Meanwhile, the surface area of an imaginary spherical surface of the golf ball means the surface area of a sphere on the assumption that the golf ball is of a sphere having no dimples formed thereon, and includes the imaginary spherical portion la shown by a dotted line and a land portion 1*b* represented by a solid line in FIG. 2.

According to the present invention, when the ratio of the sum total of the areas of all dimples 2 provided on the golf ball 1A, to the surface area of the imaginary spherical surface of the golf ball 1A, is represented by a value y, said value y is set within a range to be mentioned below from the relation with respect to the total number of the dimples 2. (Accordingly, the above value y may be regarded as an index showing the extent of the spherical surface of the golf ball covered by the dimples 2, and 100 times the value y represents the surface area occupying rate of the dimples).

More specifically, an optimum value Y of the value y is obtained by an equation, $$Y=0.046\cdot X^{\frac{1}{2}}-0.172 \quad (1)$$

(wherein X represents the total number of dimples as stated earlier).

Thus, with respect to the optimum value Y, the total number X of the dimples 2 and the sum total of the areas of the dimples 2 are set so that the value y enters the range of $\pm 0.04$.

The above equation (1) and the range of $\pm 0.04$ for the value Y are those obtained by various experimental data to be described later, and specify the range in which "carry" and "run" of the golf ball are well balanced to provide a large total flying distance, with optimized trajectory height. As described later, according to experimental data, when the value y exceeds the above range, the hit golf ball becomes a so-called "hop ball" with a high trajectory, with a small "run" and a short flying distance in total. Meanwhile, when the value y falls below the above value, the hit golf ball becomes a so-called "rod ball" at a low trajectory, with a small "carry" and a short flying distance in total.

It is seen from the above equation (1) that, in order to optimize the trajectory height and increase the flying distance of the golf ball, the value y may be made large as the total number X of the dimples 2 is increased, i.e. the surface area occupying rate of the dimples 2 may be increased, while, on the contrary, the value y may be reduced as the total number X of dimples 2 is decreased, i.e. the surface area occupying rate may be made smaller.

Meanwhile, in the golf ball according to the present invention, although the kind of diameters of the dimples to be formed on one golf ball is not particularly limited, it is preferable to adopt a plurality of kinds of diameters for the dimples to optimize said value y.

By way of example, if it is intended to increase the value y, the gaps among the dimples become large when only one kind of dimples is employed, and thus, the extent for increasing the value y is undesirably limited. On the contrary, by combining the dimples with different diameters, it becomes possible to fill the gaps among the large dimples with small dimples, and thus, the value y can be increased as required.

Furthermore, in the golf ball according to the present invention, it is preferable to set the total volumes of the dimples in the range of 290 to 370 $mm^3$. More specifically, in the case where the total volume is less than 290 $mm^3$, the golf ball is undesirably "blown up", while when the total volume exceeds 370 $mm^3$, the trajectory is depressed to be low, and in both cases, sufficient flying distance can not be achieved.

With respect to the volume of the above dimple 2, it is so arranged as described hereinbelow for reduction of the difference in the dimple effect between the seam portion not formed with dimples and other portions formed with dimples.

Figure 3:
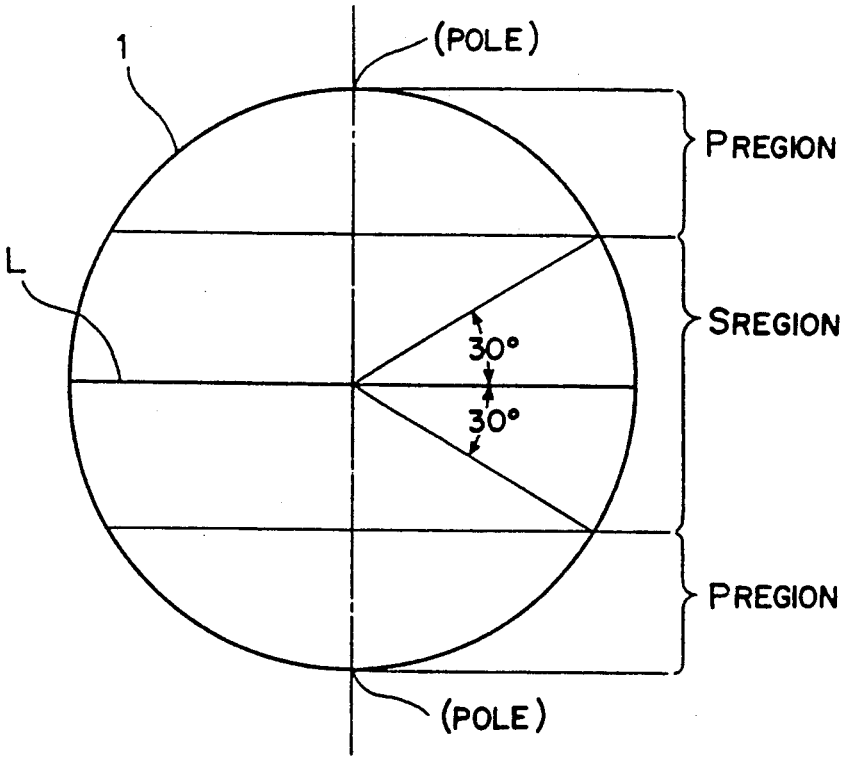
FIG. 3 is a schematic diagram showing a golf ball divided into S and P regions, FIG. 4 (I) is a front elevational view showing a dimple pattern of a golf ball 1B according to a second embodiment of the present invention, FIG. 4(II) is a view similar to FIG. 4(I) which particularly shows arrangement of dimples according to kinds thereof.

More specifically, on the spherical surface of the golf ball as shown in FIG. 3, a region including portions not formed with the dimples at each side of a parting line L (seam) is set to be an S region less than 30° in the central angle of the sphere, while a region in the vicinity of each pole at more than 30° in the central angle of the sphere is set to be a P region for differentiation, and the dimples arranged in the S region and those arranged in the P region having the same diameter are altered in volume for differentiation from each other.

Moreover, the volumes of the dimples of the same diameter arranged in the S region are represented by VS, while the volumes of the dimples having the same diameter as above and arranged in the P region are denoted by VP, and the ratio VS/VP thereof is set as follows from the relation with respect to the above value y.

(a) in a golf ball of $y<0.70$, $$1.02 \leqq VS/VP < 1.10$$

(b) in a golf ball of $0.70 \leqq y < 0.80$, $$1.10 \leqq VS/VP < 1.18, \text{ and}$$

(c) in a golf ball of $0.80 \leqq y$, $$1.18 \leqq VS/VP$$

The settings as described above have been obtained from results of various experiments, and the ratio VS/VP is made larger, since the difference in the dimple effect between the seam portion where no dimples are formed and other portions of the golf ball surface is increased as the dimples are arranged more closely. On the other hand, since the above difference in the dimple effect therebetween is decreased as the dimples are arranged more sparsely, the ratio VS/VP is made smaller.

According to the present embodiment, as shown in FIG. 1(II), four kinds of dimples A,B,C and D different in diameters are provided both in the S and P regions, and the dimple with a diameter A in the region S is represented as AS, the dimple with a diameter A in the region P, as AP, and in the similar manner, dimples BS and BP, CS and CP and DS and DP are provided as illustrated. The above dimples AS and AP are different from each other in volume, although the same in the diameter, and dimples BS and BP, CS and CP, and DS and DP are also in the similar relation as above.

It is to be noted here that, in the golf ball 1A of FIGS. 1(I) and 1(II), the center 0 of the circle coincides with the pole of the golf ball, and the outer circumference thereof is equivalent to the parting line L. Accordingly, in FIG. 1(II) showing the dimple pattern, in the region close to the center 0 of the circle (P region), the dimples AP to DP are disposed, while in the region close to the outer periphery (S region), the dimples AS to DS are arranged.

In the golf ball 1A according to the first embodiment as shown in the above FIGS. 1(I) and 1(II), the total number of dimples 2 , diameter, depth, volume, total volume, ratio VS/VP, value y and value Y of respective dimples according to the kinds of dimples are set as shown in Table 1 below.

More specifically, since the total number of dimples is 480, the ideal value Y becomes 0.842. The value y is set at 0.819 which is in the range of $0.842 \pm 0.04$. The value y, which is 0.819, is equivalent to the item (C) described earlier, and therefore, the ratio VS/VP for each of the diameter A,B,C and D is set to be 1.20.

It should also be noted here that the golf ball is of a thread wound ball having a balata cover and a liquid center, with external diameter of $42.75 \pm 0.05$ mm and compression of $95 \pm 2$.

TABLE 1

| | Dimple specifications for the golf balls according to the embodiments | | | | | | | | |
|---|---|---|---|---|---|---|---|---|---|
| | Dimple number | | | | | | | | |
| | Total | Kind-number | Dia. (mm) | Dep. (mm) | Vol. (mm3) | VS/VP | Total vol. (mm3) | Value y | Value Y |
| 1st embod. | 480 | AS-78 | 3.95 | 0.152 | 0.930 | 1.20 | 323 | 0.819 | 0.842 |
| | | AP-108 | ↑ | 0.126 | 0.775 | | | | |
| | | BS-84 | 3.55 | 0.148 | 0.734 | ↑ | | | |
| | | BP-66 | ↑ | 0.124 | 0.612 | | | | |
| | | CS-18 | 3.05 | 0.154 | 0.566 | ↑ | | | |
| | | CP-42 | ↑ | 0.129 | 0.472 | | | | |
| | | DS-36 | 2.75 | 0.152 | 0.453 | ↑ | | | |
| | | DP-48 | ↑ | 0.127 | 0.378 | | | | |
| 2nd embod. | 432 | AS-66 | 4.20 | 0.149 | 1.036 | 1.18 | 322 | 0.816 | 0.790 |
| | | AP-78 | ↑ | 0.127 | 0.878 | | | | |
| | | BS-48 | 3.85 | 0.149 | 0.866 | ↑ | | | |
| | | BP-48 | ↑ | 0.126 | 0.734 | | | | |
| | | CS-24 | 3.45 | 0.148 | 0.693 | ↑ | | | |
| | | CP-24 | ↑ | 0.125 | 0.587 | | | | |
| | | DS-72 | 3.15 | 0.150 | 0.585 | ↑ | | | |
| | | DP-72 | ↑ | 0.127 | 0.495 | | | | |
| 3rd embod. | 408 | AS-88 | 4.05 | 0.151 | 0.975 | 1.15 | 321 | 0.797 | 0.763 |
| | | AP-128 | ↑ | 0.132 | 0.848 | | | | |
| | | BS-16 | 3.90 | 0.154 | 0.920 | ↑ | | | |
| | | BP-32 | ↑ | 0.134 | 0.800 | | | | |
| | | CS-64 | 3.50 | 0.147 | 0.711 | ↑ | | | |
| | | CP-32 | ↑ | 0.128 | 0.618 | | | | |
| | | DS-16 | 2.80 | 0.152 | 0.471 | ↑ | | | |
| | | DP-32 | ↑ | 0.133 | 0.410 | | | | |
| 4th embod. | 384 | AS-72 | 4.15 | 0.155 | 1.050 | 1.13 | 320 | 0.762 | 0.735 |
| | | AP-72 | ↑ | 0.137 | 0.930 | | | | |
| | | BS-72 | 3.85 | 0.155 | 0.902 | ↑ | | | |
| | | BP-72 | ↑ | 0.137 | 0.798 | | | | |
| | | CS-24 | 3.35 | 0.156 | 0.690 | ↑ | | | |

TABLE 1-continued

| | Dimple specifications for the golf balls according to the embodiments | | | | | | | | |
|---|---|---|---|---|---|---|---|---|---|
| | Dimple number | | | | | | Total | | |
| | Total | Kind-number | Dia. (mm) | Dep. (mm) | Vol. (mm3) | VS/VP | vol. (mm3) | Value y | Value Y |
| | | CP-24 | ↑ | 0.138 | 0.610 | | | | |
| | | DS-30 | 2.95 | 0.153 | 0.523 | ↑ | | | |
| | | DP-18 | ↑ | 0.135 | 0.462 | | | | |
| 5th embod. | 342 | AS-84 | 3.95 | 0.170 | 1.042 | 1.08 | 320 | 0.678 | 0.684 |
| | | AP-60 | ↑ | 0.157 | 0.965 | | | | |
| | | BS-96 | 3.70 | 0.170 | 0.915 | ↑ | | | |
| | | BP-102 | ↑ | 0.157 | 0.347 | | | | |

In the above Table 1, the dimple diameter means a distance between connecting points when the outer peripheral edges at the left and right of the dimple are connected by line, i.e. a distance between the points A and B in FIG. 2, and the depth of the dimple represents a length of a perpendicular from the above line onto the deepest point of the dimple, i.e. a distance C to D in FIG. 2. The dimple volume means the volume in the hatched portion in FIG. 2, and the sum total of the volumes of all dimples for one golf ball become the total volume.

EXPERIMENTS

Comparative tests were carried out through employments of golf balls provided with dimples in the setting range according to the present invention, and golf balls provided with dimples outside the above setting range.

For the experiments, as shown in Table 1, in addition to the 1st embodiment, golf balls for 2nd to 5th embodiments were included in which various specifications including the total number of dimples, etc. had been altered. Meanwhile, golf balls for two comparative examples respectively corresponding to the 1st to 5th embodiments were also provided.

Figure 4I:
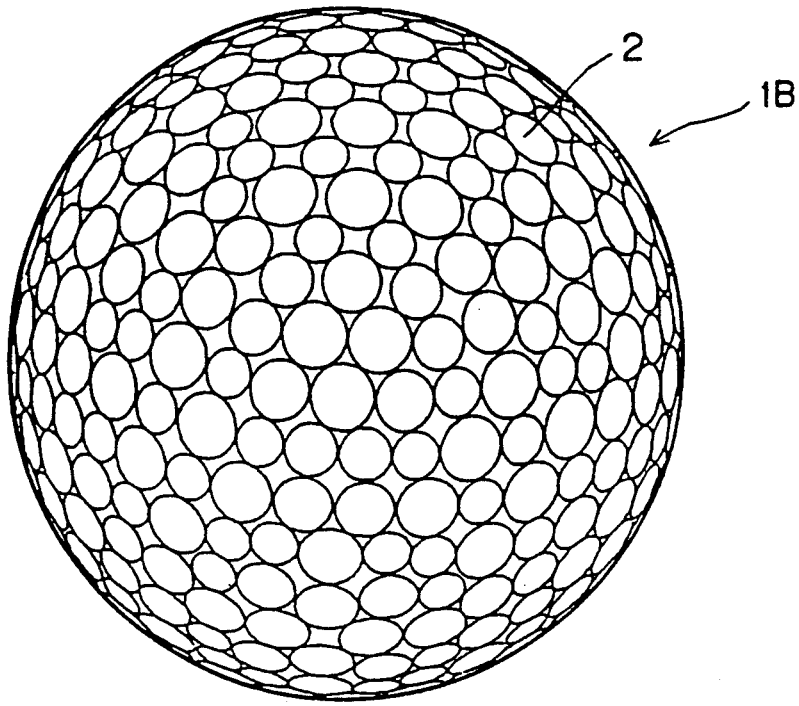
Figure 4:
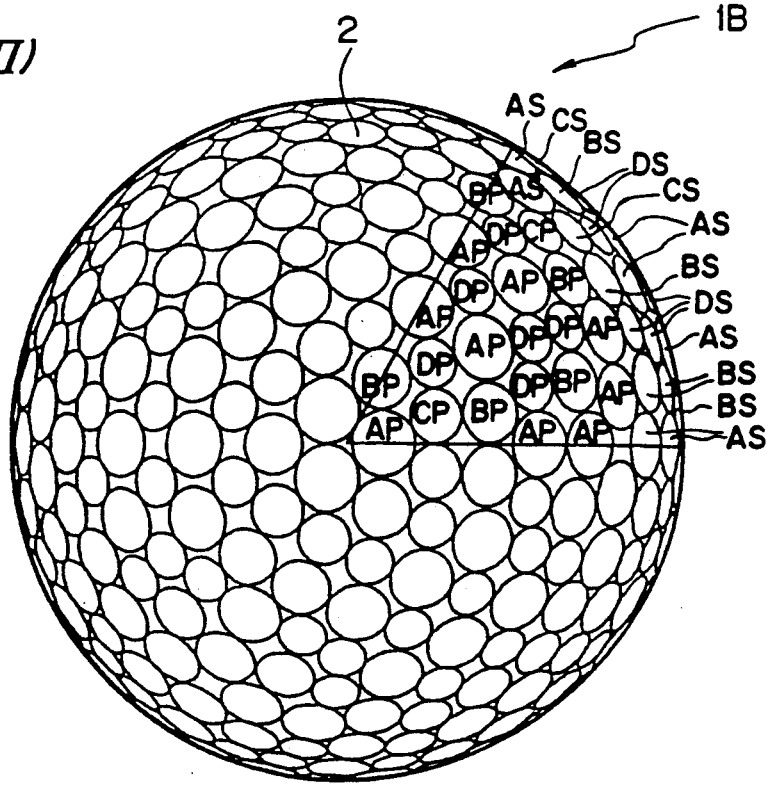

The dimple patterns for the 1st and 6th comparative examples are the same as those in FIGS. 1(I) and 1(II) for the 1st embodiment. The golf ball 1B for the 2nd embodiment is shown in FIGS. 4(I) and 4(II). Similar to FIG. 1(II), in FIG. 4(II), the dimples having the diameter A for the region P are represented as AP, and those having the same diameter A for the region S are denoted as AS, with similar representation for the diameters B,C and D.

The dimple patterns for comparative examples 2and 7 corresponding to the 2nd embodiment are the same as in FIGS. 4(I}and 4(II), with only the value y being differentiated for the respective dimples.

Figure 5I:
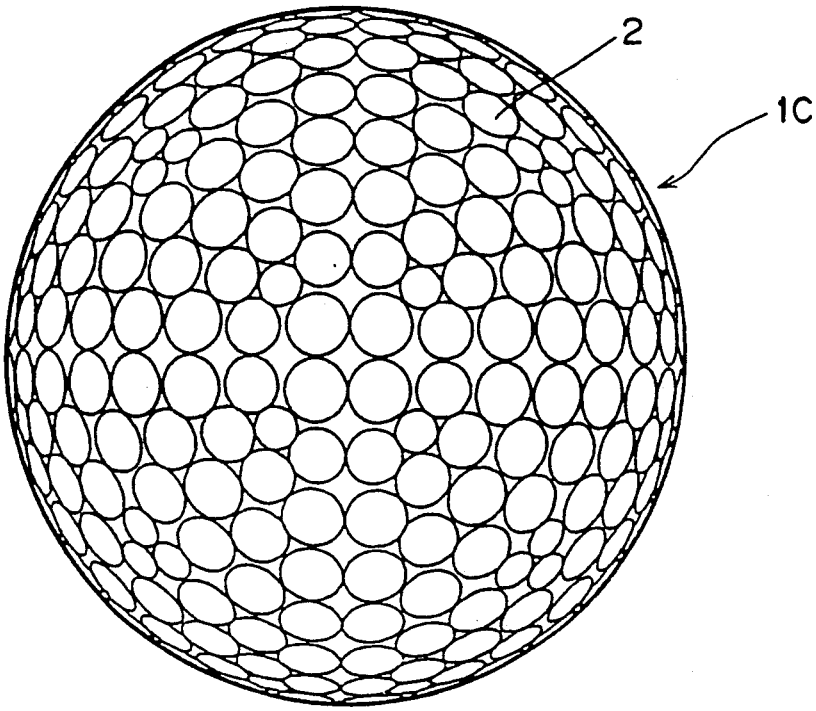
FIG. 5(I) is a front elevational view showing a dimple pattern of a golf ball 1C according to a third embodiment of the present invention, FIG. 5(II) is a view similar to FIG. 5(I) which particularly shows arrangement of dimples according to kinds thereof.
Figure 5:
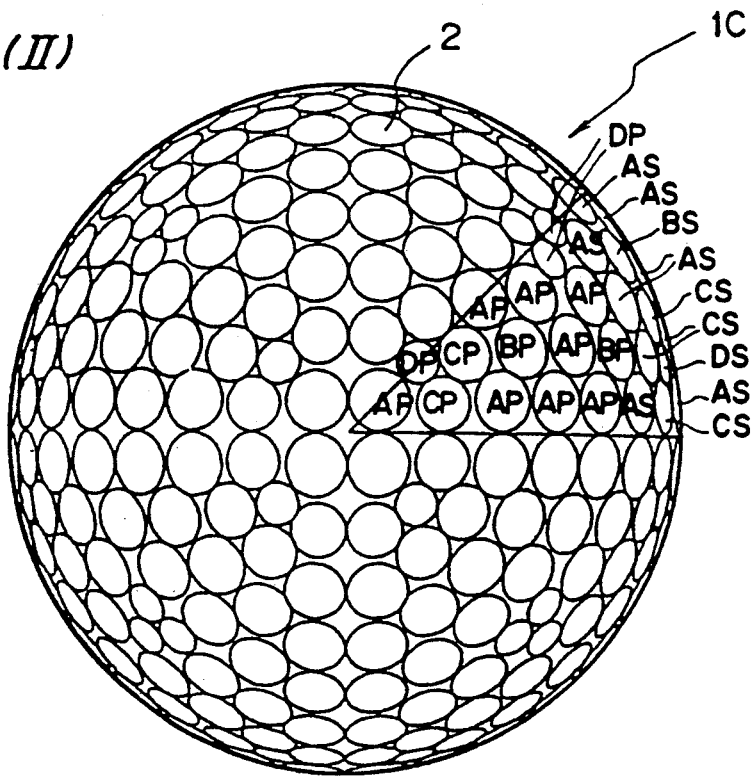
Figure 6I:
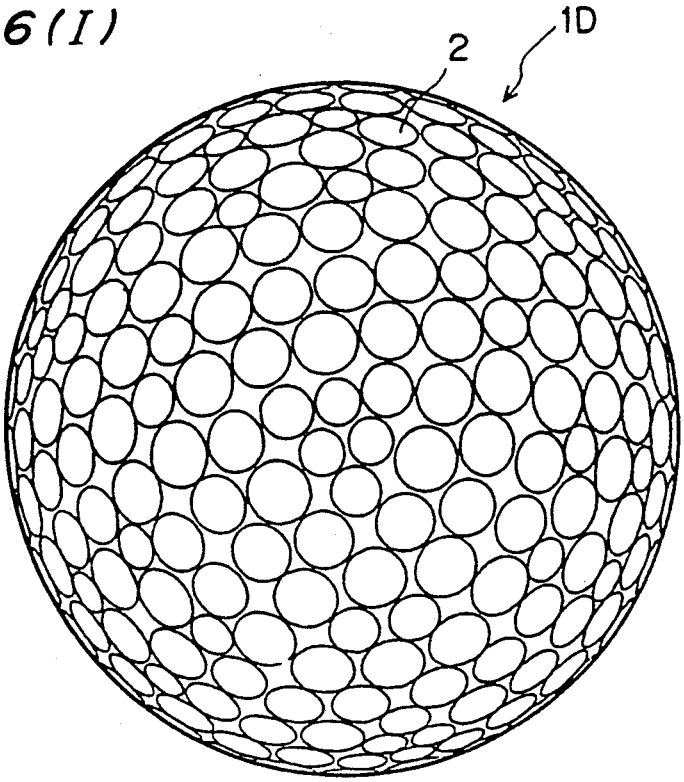
FIG. 6(I) is a front elevational view showing a dimple pattern of a golf ball 1D according to a fourth embodiment of the present invention, FIG. 6(II) is a view similar to FIG. 6(I) which particularly shows arrangement of dimples according to kinds thereof.
Figure 6:
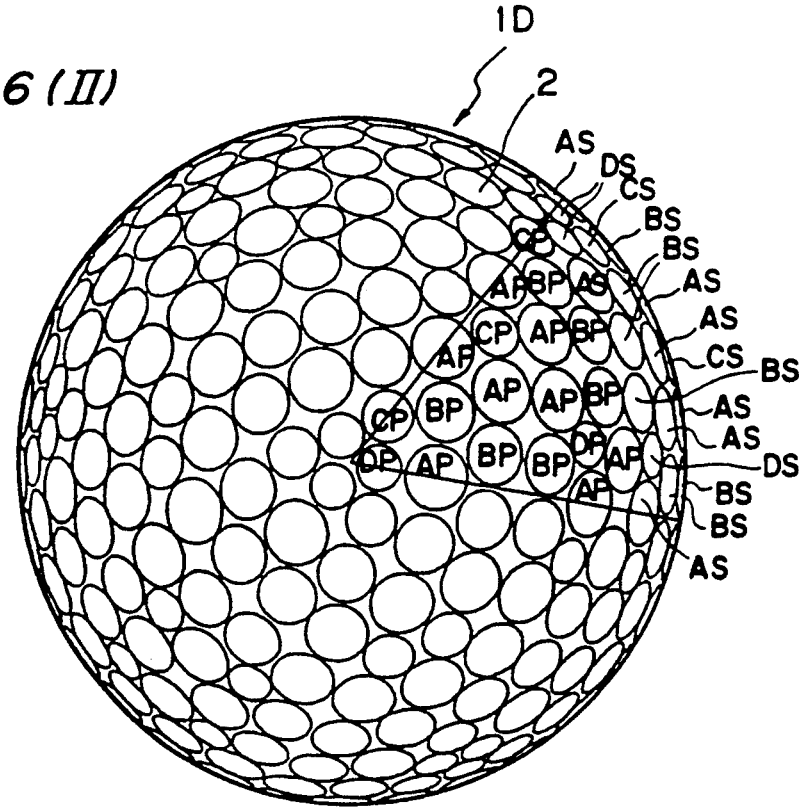
Figure 7I:
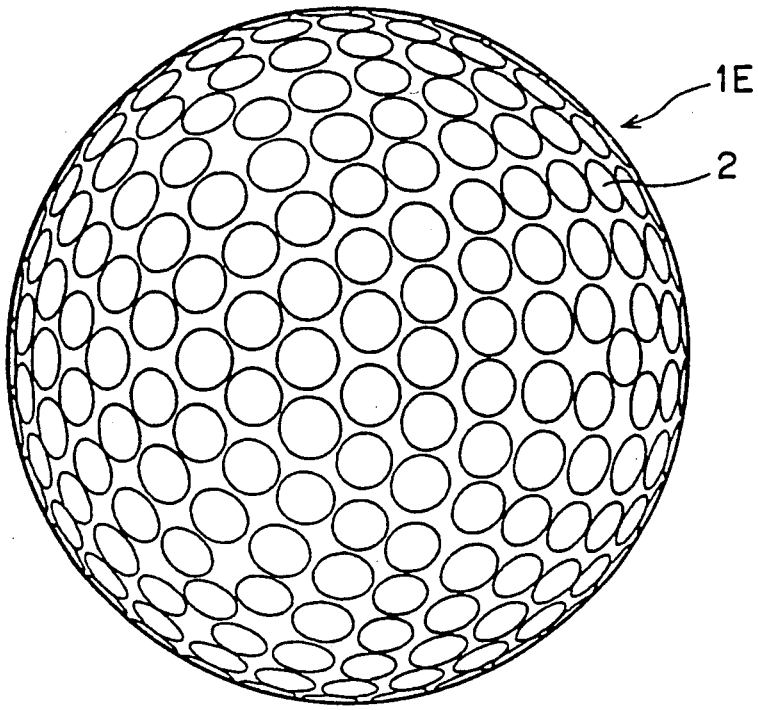
FIG. 7(I) is a front elevational view showing a dimple pattern of a golf ball 1E according to a fifth embodiment of the present invention, and FIG. 7(II) is a view similar to FIG. 7(I) which particularly shows arrangement of dimples according to kinds thereof.
Figure 7:
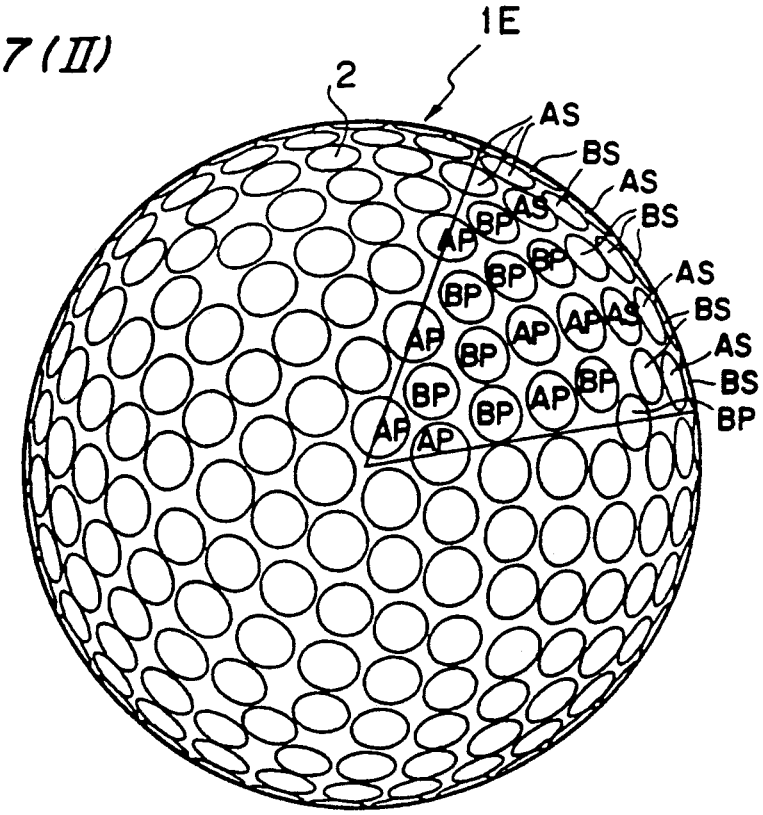

The 3rd embodiment, and 3rd and 8th comparative examples have dimple pattern as shown in FIGS. 5(I) and 5(II), and the 4th embodiment, and 4th and 9th comparative data have dimple pattern shown in FIGS. 6(I) and 6(II). The 5th embodiment, and 5th and 10th comparative examples have dimple patterns as illustrated in FIGS. 7(I) and 7(II).

The golf balls for the respective embodiments and comparative examples are the thread-wound balls having the balata covers and liquid centers similar to the golf ball of the 1st embodiment, with the same construction and compositions. Moreover, the external diameter and compression of these golf balls are also set to be similar to those of the golf ball of the 1st embodiment.

The various specifications of the golf balls 1A to 1E of the 1st to 5th embodiments are shown in the above Table 1, those for the 1st to 5th comparative examples are given in Table 2 below, and those for the 6th to 10th comparative examples are shown in Table 3 subsequent to Table 2.

TABLE 2

| | Dimple specifications for the golf balls according to comparative examples | | | | | | | | |
|---|---|---|---|---|---|---|---|---|---|
| | Dimple number | | | | | | Total | | |
| | Total | Kind-number | Dia. (mm) | Dep. (mm) | Vol. (mm3) | VS/VP | vol. (mm3) | Value y | Value Y |
| 1st Compar. | 480 | AS-78 | 4.10 | 0.142 | 0.939 | 1.25 | 319 | 0.889 | 0.842 |
| | | AP-108 | ↑ | 0.114 | 0.751 | | | | |
| | | BS-84 | 3.70 | 0.137 | 0.735 | ↑ | | | |
| | | BP-66 | ↑ | 0.109 | 0.588 | | | | |
| | | CS-18 | 3.20 | 0.144 | 0.581 | ↑ | | | |
| | | CP-42 | ↑ | 0.115 | 0.465 | | | | |
| | | DS-36 | 2.90 | 0.140 | 0.463 | ↑ | | | |
| | | DP-48 | ↑ | 0.112 | 0.370 | | | | |
| 2nd Compar. | 432 | AS-66 | 4.30 | 0.145 | 1.057 | 1.23 | 322 | 0.860 | 0.790 |
| | | AP-78 | ↑ | 0.118 | 0.859 | | | | |
| | | BS-48 | 3.95 | 0.144 | 0.883 | ↑ | | | |
| | | BP-48 | ↑ | 0.117 | 0.717 | | | | |
| | | CS-24 | 3.55 | 0.142 | 0.706 | ↑ | | | |
| | | CP-24 | ↑ | 0.116 | 0.574 | | | | |
| | | DS-72 | 3.25 | 0.143 | 0.596 | ↑ | | | |
| | | DP-72 | ↑ | 0.117 | 0.484 | | | | |
| 3rd Compar. | 408 | AS-88 | 4.15 | 0.146 | 0.992 | 1.21 | 318 | 0.839 | 0.763 |
| | | AP-128 | ↑ | 0.121 | 0.820 | | | | |
| | | BS-16 | 4.00 | 0.149 | 0.939 | ↑ | | | |
| | | BP-32 | ↑ | 0.123 | 0.776 | | | | |
| | | CS-64 | 3.60 | 0.139 | 0.711 | ↑ | | | |
| | | CP-32 | ↑ | 0.115 | 0.588 | | | | |
| | | DS-16 | 2.90 | 0.150 | 0.493 | ↑ | | | |
| | | DP-32 | ↑ | 0.124 | 0.411 | | | | |

TABLE 2-continued

| | Dimple specifications for the golf balls according to comparative examples | | | | | | | | |
|---|---|---|---|---|---|---|---|---|---|
| | Dimple number | | | | | | Total | | |
| | Total | Kind-number | Dia. (mm) | Dep. (mm) | Vol. (mm3) | VS/VP | vol. (mm3) | Value y | Value Y |
| 4th Compar. | 384 | AS-72 | 4.25 | 0.151 | 1.072 | 1.18 | 322 | 0.802 | 0.735 |
| | | AP-72 | ↑ | 0.128 | 0.908 | | | | |
| | | BS-72 | 3.95 | 0.152 | 0.931 | ↑ | | | |
| | | BP-72 | ↑ | 0.129 | 0.789 | | | | |
| | | CS-24 | 3.45 | 0.152 | 0.714 | ↑ | | | |
| | | CP-24 | ↑ | 0.129 | 0.605 | | | | |
| | | DS-30 | 3.05 | 0.148 | 0.541 | ↑ | | | |
| | | DP-18 | ↑ | 0.125 | 0.458 | | | | |
| 5th Compar. | 342 | AS-84 | 4.10 | 0.160 | 1.057 | 1.12 | 322 | 0.733 | 0.684 |
| | | AP-60 | ↑ | 0.143 | 0.944 | | | | |
| | | BS-96 | 3.85 | 0.161 | 0.942 | ↑ | | | |
| | | BP-102 | ↑ | 0.144 | 0.841 | | | | |

TABLE 3

| | Dimple specifications for the golf balls according to comparative examples | | | | | | | | |
|---|---|---|---|---|---|---|---|---|---|
| | Dimple number | | | | | | Total | | |
| | Total | Kind-number | Dia. (mm) | Dep. (mm) | Vol. (mm3) | VS/VP | vol. (mm3) | Value y | Value Y |
| 6th Compar. | 480 | AS-78 | 3.85 | 0.158 | 0.924 | 1.16 | 324 | 0.773 | 0.842 |
| | | AP-108 | ↑ | 0.137 | 0.797 | | | | |
| | | BS-84 | 3.45 | 0.155 | 0.724 | ↑ | | | |
| | | BP-66 | ↑ | 0.133 | 0.624 | | | | |
| | | CS-18 | 2.95 | 0.161 | 0.553 | ↑ | | | |
| | | CP-42 | ↑ | 0.139 | 0.477 | | | | |
| | | DS-36 | 2.65 | 0.157 | 0.434 | ↑ | | | |
| | | DP-48 | ↑ | 0.135 | 0.374 | | | | |
| 7th Compar. | 432 | AS-66 | 4.00 | 0.163 | 1.024 | 1.13 | 320 | 0.731 | 0.790 |
| | | AP-78 | ↑ | 0.144 | 0.906 | | | | |
| | | BS-48 | 3.65 | 0.162 | 0.849 | ↑ | | | |
| | | BP-48 | ↑ | 0.143 | 0.751 | | | | |
| | | CS-24 | 3.25 | 0.161 | 0.668 | ↑ | | | |
| | | CP-24 | ↑ | 0.142 | 0.592 | | | | |
| | | DS-72 | 2.95 | 0.161 | 0.552 | ↑ | | | |
| | | DP-72 | ↑ | 0.142 | 0.488 | | | | |
| 8th Compar. | 408 | AS-88 | 3.85 | 0.164 | 0.956 | 1.11 | 319 | 0.715 | 0.763 |
| | | AP-128 | ↑ | 0.148 | 0.861 | | | | |
| | | BS-16 | 3.70 | 0.167 | 0.899 | ↑ | | | |
| | | BP-32 | ↑ | 0.150 | 0.810 | | | | |
| | | CS-64 | 3.30 | 0.162 | 0.693 | ↑ | | | |
| | | CP-32 | ↑ | 0.146 | 0.624 | | | | |
| | | DS-16 | 2.60 | 0.165 | 0.439 | ↑ | | | |
| | | DP-32 | ↑ | 0.148 | 0.395 | | | | |
| 9th Compar. | 384 | AS-72 | 3.95 | 0.169 | 1.038 | 1.08 | 320 | 0.685 | 0.735 |
| | | AP-72 | ↑ | 0.157 | 0.962 | | | | |
| | | BS-72 | 3.65 | 0.168 | 0.883 | ↑ | | | |
| | | BP-72 | ↑ | 0.156 | 0.817 | | | | |
| | | CS-24 | 3.15 | 0.167 | 0.654 | ↑ | | | |
| | | CP-24 | ↑ | 0.155 | 0.606 | | | | |
| | | DS-30 | 2.75 | 0.166 | 0.494 | ↑ | | | |
| | | DP-18 | ↑ | 0.153 | 0.457 | | | | |
| 10th Compar. | 342 | AS-84 | 3.80 | 0.181 | 1.030 | 1.05 | 320 | 0.626 | 0.684 |
| | | AP-60 | ↑ | 0.173 | 0.981 | | | | |
| | | BS-96 | 3.55 | 0.182 | 0.902 | ↑ | | | |
| | | BP-102 | ↑ | 0.173 | 0.859 | | | | |

As described above, the golf balls of the 1st and 6th comparative examples have the dimple patterns similar to the dimple pattern of the 1st embodiment, with 480 dimples in total. In the golf ball of the 1st comparative example, diameters of respective kinds of dimples are larger than those in the golf ball of the 1st embodiment, and consequently, the value y is also large at 0.889. In the golf ball of the 6th comparative example, diameters of respective kinds of dimples are smaller than those in the golf ball of the 1st embodiment, with consequently small value y at 0.773.

The golf ball 1B of the 2nd embodiment has the total number of dimples of 432, value y at 0.816 and ratio VS/VP at 1.18. The golf balls of the 2nd and 7th comparative examples have the same dimple patterns as in the golf ball 1B of the 2nd embodiment as stated earlier, with the total number of dimples of 432. The golf ball of the 2nd comparative example has the diameters of respective kinds of dimples larger than those of the golf ball 1B for the 2nd embodiment, and consequently, its value y is large at 0.860. The golf ball of the 7th comparative example has small diameters for respective kinds of dimples, and consequently, its value y is also small at 0.731.

The golf ball 1C of the 3rd embodiment has the total number of dimples of 408, value y at 0.797 and ratio VS/VP at 1.15. The golf ball for the corresponding 3rd comparative example has the diameters of respective kinds of dimples larger than those of the golf ball 1C for the 3rd embodiment, with consequently large value y at 0.839. Meanwhile, the golf ball of the 8th comparative example is small in the diameters of respective kinds of dimples, and thus, the value y is also small at 0.715.

The golf ball 1D according to the 4th embodiment has the total number of dimples of 384, and value y at 0.762. The golf ball of the 4th comparative example having the same dimple pattern is larger in the diameters of respective kinds of dimples than those of the golf ball of the 4th embodiment, and accordingly, has a large value y at 0.802. The golf ball of the 9th comparative example is smaller in the diameters of respective kinds of dimples than those of the golf ball of the 4th embodiment, with consequently small value y at 0.685.

The golf ball 1E for the 5th embodiment has the total number of dimples of 342, and value y at 0.678. The golf ball of the 5th comparative example having the same dimple pattern is larger in the diameters of respective kinds of dimples than those of the golf ball of the 5th embodiment, and accordingly, has a large value y at 0.733. The golf ball of the 10th comparative example is smaller in the diameters of respective kinds of dimples than those of the golf ball of the 5th embodiment, with consequently small value y at 0.626.

It is to be noted here that, in the above dimples for the 1st to 5th embodiments, the values y thereof are set within the range of ±0.04 with respect to the ideal value Y which can be obtained from the total number X of dimples, while the values VS/VP are set in the range defined in the items (a)(b) and (c) referred to earlier according to the above values y. On the contrary, in the golf balls of the comparative examples, the values y are set in the range departing from ±0.04 with respect to the ideal value Y to be obtained by the dimple total number X.

The golf balls 1A to 1E of the 1st to 5th embodiments and those for the 1st to 10th comparative examples, were subjected to flying distance tests through employment of a swing robot made by True temper Co., Ltd. and by using a driver (No. 1 wood) at a head speed of 45m/s.

For the respective golf balls, measurements were taken on the carry, run and total trajectory height, the results of which are shown in Table 4 below.

TABLE 4

| | Flying distance test results | | | | | |
|---|---|---|---|---|---|---|
| | Total no. of dimples | Value y | Carry (yds) | Run (yds) | Total (yds) | Trajectory height |
| 1st embod. | 480 | 0.819 | 221.3 | 17.5 | 238.8 | 13.27 |
| 1st compar. | ↑ | 0.889 | 220.6 | 11.1 | 231.7 | 13.82 |
| 6th compar. | ↑ | 0.773 | 216.6 | 18.0 | 234.6 | 12.81 |
| 2nd embod. | 432 | 0.816 | 224.4 | 16.0 | 240.4 | 13.41 |
| 2nd compar. | ↑ | 0.860 | 224.1 | 12.3 | 236.4 | 13.86 |
| 7th compar. | ↑ | 0.731 | 220.0 | 15.2 | 235.2 | 13.00 |
| 3rd embod. | 408 | 0.797 | 223.5 | 16.9 | 240.4 | 13.29 |
| 3rd compar. | ↑ | 0.839 | 222.5 | 13.0 | 235.5 | 13.72 |
| 8th compar. | ↑ | 0.715 | 219.1 | 17.0 | 236.1 | 12.88 |
| 4th embod. | 384 | 0.762 | 223.9 | 15.7 | 239.6 | 13.39 |
| 4th compar. | ↑ | 0.802 | 220.6 | 12.5 | 233.1 | 13.92 |
| 9th compar. | ↑ | 0.685 | 217.3 | 17.2 | 234.5 | 12.77 |
| 5th embod. | 342 | 0.678 | 222.2 | 14.8 | 237.0 | 13.48 |
| 5th compar. | ↑ | 0.733 | 219.8 | 10.0 | 229.8 | 13.96 |
| 10th compar. | ↑ | 0.626 | 217.1 | 14.4 | 231.5 | 12.83 |

It is to be noted here that the data given in the above Table 4 are average values of 20 golf balls tested for the respective embodiments and comparative examples. During the test, the machine conditions were so adjusted that the back-spin immediately after launching of the golf ball became 3500 rpm ±300 rpm, with the launching angle of the golf ball being 10°±0.5°. The state of wind during the tests was of fair wind at 0.5 to 1.8m/s.

In Table 4, the "carry" represents a distance from a launching point of the golf ball to a point where the golf ball was first dropped, while the "run" denotes a distance from the above dropping point to a stopping point of the golf ball, and the "total" indicates the sum of the carry and run, which represents an ultimate flying distance. The trajectory height represents an angle of elevation at the highest point of the trajectory as viewed from the launching point, and the larger the value thereof, the golf ball may be regarded to have a higher trajectory.

As shown in the test results of Table 4, with respect to the golf balls having the number of dimples of 480, the golf ball with the value y of 0.819 flies best at the total of 238.8 yards. The golf ball of the 1st comparative example having the value y at 0.889 is a "hop" ball with a high trajectory height at 13.82 and a small run, and consequently, its total is limited only to 231.7 yards. Meanwhile, the golf ball of the 6th comparative example having the value y at 0.773 is a "rod ball" , with a low trajectory height at 12.81 and a small carry, and consequently, its total is limited only to 234.6 yards. From these results, it has been confirmed that, in the golf ball having the total number of dimples at 480, by setting the value y to 0.819 close to ±0.04 with respect to the value Y to be obtained by the equation (1), the flying distance can be increased advantageously.

Moreover, in Table 4, of the golf balls having the total number of dimples of 432 , the golf ball of the 2nd embodiment having the value y at 0.816 flew best with the total of 240.4 yards. The golf ball of the second comparative example with the value y at 0.860 is of a "hop ball" with a small run, and consequently, the total thereof is limited to 236.4 yards. The golf ball according to the 7th comparative example having the value y at 0.731 is of a "rod ball" low in its trajectory height at 13.00, with a small carry, and therefore, is limited only to 235.2 yards in its total.

From the above results, it has been found that in the golf ball having the total number of dimples of 432, by setting the value y in the vicinity of 0.816, the total flying distance of the golf ball is prolonged.

In Table 4, in the golf balls having the total number of dimples of 408, the golf ball of the 3rd embodiment having the value y at 0.797 flew best with the total of 240.4 yards. The golf ball of the 3rd comparative example with the value y at 0.839 is of a "hop ball" with a small run, and consequently, the total thereof is limited to 235.5 yards. The golf ball according to the 8th comparative example having the value y at 0.715 is of a "rod ball" low in its trajectory height at 12.88, with a small carry, and therefore, is limited only to 236.1 yards in its total.

From the above results, it has been found that in the golf ball having the total number of dimples of 408, by setting the value y at 0.797 the total flying distance of the golf ball is prolonged.

Meanwhile, in Table 4, of the golf balls having the total number of dimples of 384, the golf ball 1D of the 4th embodiment having the value y at 0.762 flew best with the total of 239.6 yards. The golf ball of the 4th comparative example with the value y at 0.802 is of a "hop ball" having a high trajectory height at 13.92 with a small run, and consequently, the total thereof is limited to 233.1 yards. The golf ball according to the 9th comparative example having the value y at 0.685 is of a "rod ball" low in its trajectory height at 12.77, with a small carry, and therefore, is limited only to 234.5 yards in its total.

From the above results, it has been found that in the golf ball having the total number of dimples of 384, the value y should preferably be set in the vicinity of 0.762.

Furthermore, in Table 4, in the golf balls having the total number of dimples of 342, the golf ball 1E of the 5th embodiment having the value y at 0.678 flew best with the total of 237.0 yards. The golf ball of the 5th comparative example with the value y at 0.733 is of a "hop ball" having a high trajectory height at 13.96 with a small run, and consequently, the total thereof is limited to 229.8 yards. The golf ball according to the 10th comparative example having the value y at 0.626 is of a "rod ball" low in its trajectory height at 12.83, with a small carry, and therefore, is limited only to 231.5 yards in its total.

From the above results, it has been found that also in the golf ball having the total number of dimples of 342, by setting the value y in the vicinity of 0.678, the total flying distance of the golf ball is increased.

As is clear from the foregoing description, in the golf ball according to the present invention, since the surface area occupying rate of the dimples is set through the optimum combination with the total number of the dimples, the trajectory may be optimized in dimple patterns of any design for increased flying distance of the golf ball.

Furthermore, in the golf ball according to the present invention, it is so arranged to eliminate the difference in the dimple effect between the region including the seam portion without dimples and other regions by setting the volume ratio of the dimples based on the relation of the surface area occupying rate of the dimples and the total number of dimples, and therefore, the aerodynamic characteristics such as trajectory height, flying distance, etc. are less affected by the position for hitting the golf ball.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A golf ball which comprises a spherical surface having a parting line at its equator and having a plurality of dimples formed thereon, wherein said dimples are formed so that the ration, y, of the sum total of the flat surface area of the dimples to the surface area of the same sphere having no dimples formed thereon is within the range $$((0.046)(X)^{\frac{1}{2}}-0.172)+0.04 \geqq y \geqq ((0.046)(X)^{\frac{1}{2}}-0.172)-0.04$$

wherein X represents the total number of dimples; and wherein a dimple lying within a region S, which extends from 30° below the parting line to 30° above the parting line, has a volume VS, and a dimple of the same diameter only lying within the region P, which comprises the surface of the sphere that is not within region S, has a volume VP, such that the ratio of the volumes of dimples having the same diameters but in different regions is within the range of;

$1.02 \leqq VS/VP < 1.10$, when $y < 0.70$, $1.10 \leqq VS/VP < 1.18$, when $0.70 \leqq y < 0.80$, and $1.18 \leqq VS/VP$, when $0.80 \leqq y$.

2. The golf ball according to claim 1, wherein said dimples consist of 186 dimples having a diameter of 3.95mm, 150 dimples having a diameter of 3.55mm, 60 dimples having a diameter of 3.05mm, and 84 dimples having a diameter of 2.75mm.

3. The golf ball according to claim 1, wherein said dimples consist of 144 dimples having a diameter of 4.20mm, 96 dimples having a diameter of 3.85mm, 48 dimples having a diameter of 3.45mm, and 144 dimples having a diameter of 3.15mm.

4. The golf ball according to claim 1, wherein said dimples consist of 216 dimples having a diameter of 4.05mm, 48 dimples having a diameter of 3.90mm, 96 dimples having a diameter of 3.50mm, and 48 dimples having a diameter of 2.80mm.

5. The golf ball according to claim 1, wherein said dimples consist of 144 dimples having a diameter of 4.15mm, 144 dimples having a diameter of 3.85mm, 48 dimples having a diameter of 3.35mm, and 48 dimples having a diameter of 2.95mm.

6. The golf ball according to claim 1, wherein said dimples consists of 144 dimples having a diameter of 3.95mm, and 198 dimples having a diameter of 3.70mm.

7. The golf ball according to claim 1, wherein said dimples include a plurality of kinds of dimples having different diameters.

8. The golf ball according to claim 1, wherein the total volumes of the dimples are in the range of 290 to $370mm^3$.

* * * * *